US008159314B1

(12) United States Patent
Estes

(10) Patent No.: US 8,159,314 B1
(45) Date of Patent: Apr. 17, 2012

(54) ACTIVELY TUNED FILTER

(75) Inventor: John C. Estes, Tempe, AZ (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 435 days.

(21) Appl. No.: 12/221,542

(22) Filed: Aug. 4, 2008

(51) Int. Cl.
*H01P 1/201* (2006.01)
*H01P 1/203* (2006.01)
*H01P 7/00* (2006.01)

(52) U.S. Cl. ..... 333/202; 333/235; 333/205

(58) Field of Classification Search ..... 333/165–168, 333/175, 176, 185, 202–207, 24 C, 219, 235
See application file for complete search history.

(56) References Cited

U.S. PATENT DOCUMENTS

| | | | | |
|---|---|---|---|---|
| 3,939,443 | A * | 2/1976 | Biro et al. | 333/202 |
| 4,835,499 | A | 5/1989 | Pickett | |
| 6,525,630 | B1 * | 2/2003 | Zhu et al. | 333/205 |
| 7,236,068 | B2 | 6/2007 | Shamsaifar et al. | |
| 7,646,264 | B2 * | 1/2010 | Petrovic | 333/176 |
| 2008/0309429 | A1 * | 12/2008 | El Rai | 333/167 |
| 2010/0073107 | A1 * | 3/2010 | Prophet et al. | 333/204 |

OTHER PUBLICATIONS

Kapilevich, B. et al; "Bandpass varactor tunable filters using step impedance resonators"; The College of Judea and Samaria, Dept. of Electrical and Electronics Eng., Ariel, Israel; pp. 285-288; 2004.
Brown, A., et al; "A Varactor Tuned RF Filter";IEEE Transactions on MTT, Oct. 29, 1999; pp. 1-4.
Saeedi, S., et al; Design, Simulation and Fabrication of a Varactor Tunable Combline Microwave Filter; EE Dept, Iran University of Science and Technology, Tehran, Iran; IEEE 2005: pp. 1-3.
Sanchez-Renedo. M., et. al; "Tunable Combline Filter With Continuous Control of Center Frequency and Bandwith"; IEEE Transactions On Microwave Theory and Techniques, vol. 53. No. 1. Jan. 2005, pp. 191-199.

* cited by examiner

*Primary Examiner* — Robert Pascal
*Assistant Examiner* — Gerald Stevens
(74) *Attorney, Agent, or Firm* — Donna P. Suchy; Daniel M. Barbieri

(57) ABSTRACT

An actively tuned filter providing a constant bandwidth at a plurality of frequencies. The filter includes first and second electromagnetically coupled coiled resonators, each resonator having an open end configured to receive an input and a shorted end configured to connect the resonator to a ground. The filter further includes a variable capacitance allowing selection of a capacitance to be applied to the first and second resonators, each variable capacitance being connected to the shorted end of the first and second resonators between the resonator and the ground where the axes of the coils of the first and second resonators are aligned along a single axis.

15 Claims, 5 Drawing Sheets

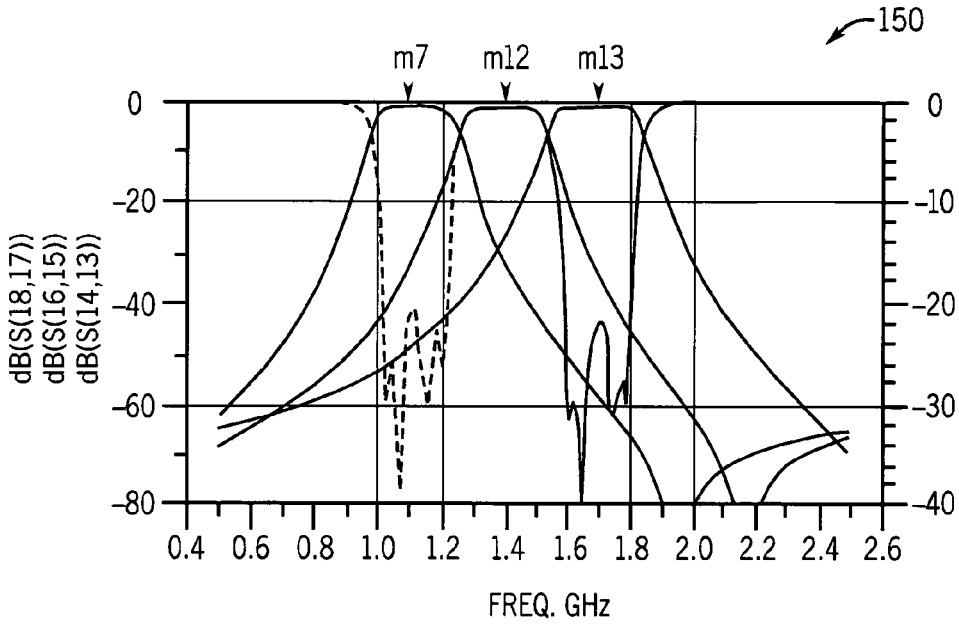
FIG. 1C (PART 1)
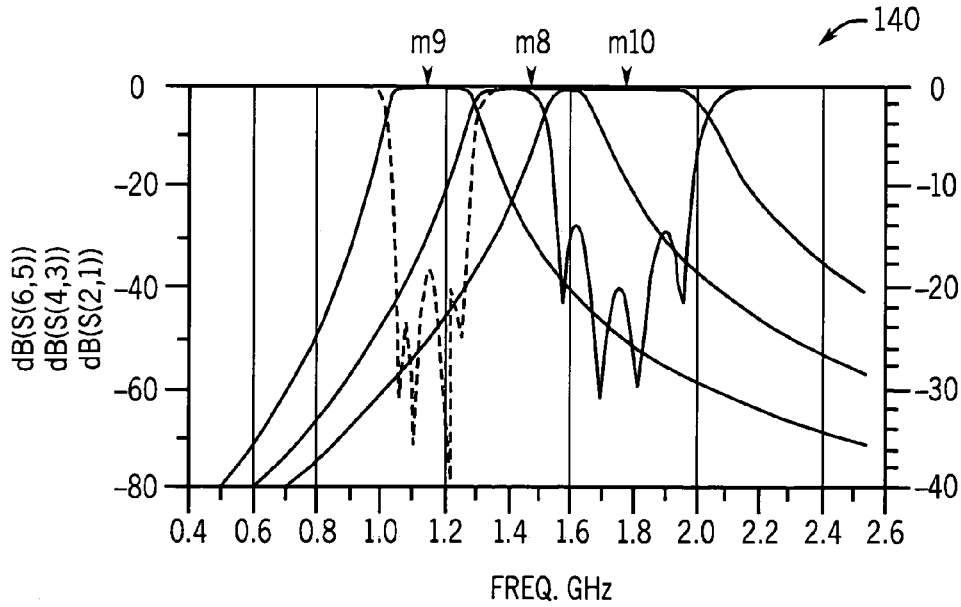
FIG. 1C (PART 2)

ACTIVELY TUNED FILTER

BACKGROUND

The present invention relates generally to the field of tunable filters. More particularly, the present invention relates to tunable filter covering an appreciable frequency range while maintaining a constant bandwidth over that range.

Tunable filters offer communications service providers flexibility and scalability never before accessible. A single tunable filter can replace several fixed filters covering adjacent frequencies. This versatility provides transceiver front end RF tunability in real time applications and decreases deployment and maintenance costs through software controls and reduced component count. Tunable filters, although typically narrow band, can cover a larger frequency band than fixed filters by tuning over a wide range. Narrowband filters at the front end are appreciated from a systems point of view because they provide better selectivity and help reduce interference from nearby transmitters.

There are many potential uses for miniaturized, low-cost, tunable filters. Examples include software reconfigurable radios, mobile communications, and wideband radar systems. However, traditional varactor or switched capacitor tuned filter approaches have limitations caused by insertion loss and/or bandwidth variation. For example, stepped impedance resonant filters, in which the resonant frequency is tuned by direct physical transmission line adjustment, use external and internal lumped element networks to vary the coupling across the tuning range in order to eliminate bandwidth variation. However this approach requires active gain elements to compensate for the loss variation. In another example, comb-line and inter-digital filters, in which the resonant frequency is tuned by indirect capacitive loading of the resonant transmission line elements, use switchable coupling capacitors along the length of the resonator lines in order to eliminate the bandwidth variation. However, these types of filters tend to be complicated.

Current methods of actively turning filters require that the coupling between resonators be tuned as the resonant frequency of resonators is tuned in order to achieve constant bandwidth across the tuning range. This coupling between resonators, whether magnetic or electric, is very small and very sensitive. Accordingly, it is challenging if not prohibitive due to manufacturing and yield costs to design tunable filters having a dynamic coupling between resonators.

What is needed is an actively tuned filter in which an inter-resonator coupling of resonators decreases as the turning frequency is increased thereby maintaining constant bandwidth. What is further needed is such a filter where only the resonant frequency of the resonators is actively tuned and complicated internal coupling networks are not required.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

One embodiment of the invention relates to an actively tuned filter providing a constant bandwidth at a plurality of frequencies. The filter includes electromagnetically coupled first and second resonators, each resonator having an open end configured to receive an input and a shorted end configured to connect the resonator to a ground. The axes of the coils of the first and second resonators may be aligned along a single axis. The filter further includes a variable capacitance allowing selection of a capacitance to be applied to the first and second resonators, each variable capacitance being connected to the shorted end of the first and second resonators between the resonator and the ground.

Another embodiment of the invention relates to a filter bank including a plurality of actively tuned filters providing a constant bandwidth at a plurality of frequencies. The filter bank includes at least two actively tuned filters the actively tuned filters configured to provide complementary tuning ranges. Each actively tuned filter includes electromagnetically coupled first and second resonators, each resonator having an open end configured to receive an input and a shorted end configured to connect the resonator to a ground, and a variable capacitance allowing selection of a capacitance to be applied to the first and second resonators. Each variable capacitance is connected to the shorted end of the first and second resonators between the resonator and the ground. The axes of the coils of the first and second resonators are aligned along a single axis.

Yet another embodiment of the invention relates to an actively tuned filter providing a constant bandwidth at a plurality of frequencies. The filter includes a first resonator having an open end configured to receive an input and a shorted end configured to connect the resonator to ground and a first variable capacitance allowing selection of a capacitance to be applied to the first resonator. The variable capacitances are connected to the shorted end of the first resonator between the resonator and the ground. The filter further includes a second resonator having an open end configured to provide an output and a shorted end configured to connect the resonator to ground and a second variable capacitance allowing selection of a capacitance to be applied to the second resonator, the variable capacitance is connected to the shorted end of the second resonator between the resonator and the ground. The filter may be configured such that the first resonator and the second resonator coils are aligned along a single axis and are connected by an electromagnetic coupling and configured to perform a filtering function.

Alternative examples and other exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which:

FIG. 1C is first and second graphs of decibels vs. frequency illustrating operation of the actively tuned filter of FIG. 1A in comparison with a prior art actively tuned filter, according to an exemplary embodiment;

DETAILED DESCRIPTION OF THE PREFERRED EMBODIMENTS

Figure 1A:
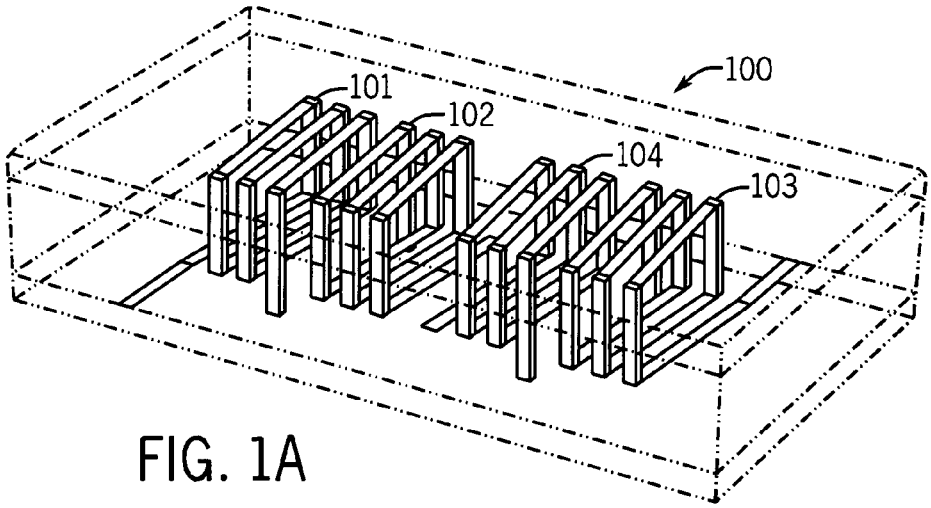
FIG. 1A is an actively tuned filter in which the shorted ends of associated resonator coils are connected to ground through variable capacitance, according to an exemplary embodiment.

Before describing in detail the particular improved system and method, it should be observed that the invention includes, but is not limited to, a novel structural combination of conventional data/signal processing components and communications hardware and software, and not in particular detailed configurations thereof. Accordingly, the structure, methods, functions, control, and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Figure 1B:
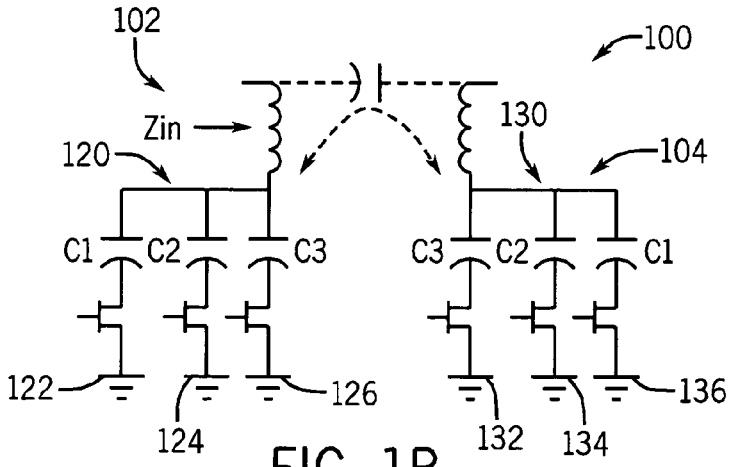
FIG. 1B is a simplified electrical circuit diagram of the actively tuned filter shown in FIG. 1A, according to an exemplary embodiment.

Referring first to FIGS. 1A and 1B, an actively tuned filter 100 in which the shorted end of associated resonator coils 101, 102, 103, and 104 are connected to ground through variable capacitance are shown, according to an exemplary embodiment. Actively tuned filter 100, having capacitance connected to the shorted end of the resonators, allows a user to vary the pass band frequency of the filters without requiring separate tuning of the coupling between the two resonators. Although filter 100 is shown as including four resonators, one of ordinary skill in the art would understand that filter 100 may include more or less resonator coils.

In contrast, traditional tunable filters have variable capacitance connected to an open end of each resonator. Although varying capacitance may be selected, the coupling capacitance of filter 100 remains constant such that the effective bandwidth increases. To maintain a constant bandwidth at various frequencies, the coupling between the resonators would need to be varied. However, varying this coupling may be difficult because the coupling is typically in the 10 to 50 pico farad (pF) range. The capacitance is further subject to parasitic inductance that can cause additional difficulties in varying the coupling.

Various structures can be used to construct the filter and resonators, such as microstrips, strip lines, coaxial lines, dielectric resonators, resonator cavities, waveguides, etc. Coiled resonators that may be used to implement filter 100 may include printed circuit boards (PCB), wire wound coils, etc. According to an exemplary embodiment, the coil axes of resonators 101-104 may be aligned in an end to end configuration along the axes to facilitate tuning. Further, although filter 100 is shown and described in a low temperature co-fired ceramics (LTCC) implementation, the method taught herein is equally applicable to other technologies.

Referring now to FIG. 1B, a simplified electrical circuit diagram 110 of two of the resonators 102 and 104 of the actively tuned filter 100 is shown, according to an exemplary embodiment. The shorted end of resonator coils 102 and 104 are connected to ground through a variable capacitance 120 and 130, respectively. Variable capacitances 120 and 130 allow a user to load the resonator 102 and 104 with different capacitors to change the resonant frequency of the filter and therefore the center frequency of the passband of the filter. Variable capacitance 120 and 130 are shown with three capacitors having unique capacitance. According to an exemplary embodiment, capacitances 120 and 130 include a first capacitor 122 and 132 of 100 pF, a second capacitor 124 and 134 of 2.0 pF, and a third capacitor 126 and 136 of 0.3 pF. The selection of the capacitance may be controlled by a FET switch as shown in FIG. 1B or any other switchable element such as a microelectromechanical switch (MEMS).

Actively tuned filter 100 includes first resonator coil 102 and second resonator coil 104. Resonators 102 and 104 are configured to resonate at a designated frequency which defines the center frequency of the filter 100. The amount of the coupling between resonators 102 and 104 defines the bandwidth.

Connecting the variable capacitance on the shorted end of the resonator changes the effective inductance of the coils to cause a change in the resonance of the resonators. However, by orienting the coil in a horizontal direction as shown in FIG. 1A, the coupling changes as the resonant frequency of the resonators changes. Over an appreciable tuning range, the coupling changes such that the bandwidth remains relatively constant. Although actively tuned filter 100 is shown in FIG. 1A in a horizontally coiled orientation with the axes of the resonator coils aligned along a single axis, filter 100 may alternatively be implemented in a vertically coiled orientation according to an alternative embodiment.

Connecting resonator coils 102 and 104 to ground through variable capacitance has the effect that the coupling of the resonators changes as the resonant frequency of the resonators is varied. Accordingly almost constant bandwidth can be maintained across the tunable range using actively tuned filter 100. Advantageously, the resonator coupling of actively tuned filter 100 does not need to be tuned and the frequency shift associated with filter 100 is not as sensitive to the value of the shorted capacitor as would otherwise be expected.

Referring now to FIG. 1C, a first graph 140 of decibels vs. frequency showing expanding bandwidth at a plurality of frequencies that occurs when utilizing a prior art actively tuned filter and a second graph 150 of decibels vs. frequency showing constant bandwidth at a plurality of frequencies utilizing actively tuned filter 100 is shown, according to an exemplary embodiment. As see in the first and second graph, connecting the variable capacitance to the shorted end of a resonator in a horizontal position allows for a constant bandwidth even at increasing frequencies.

Figure 2A:
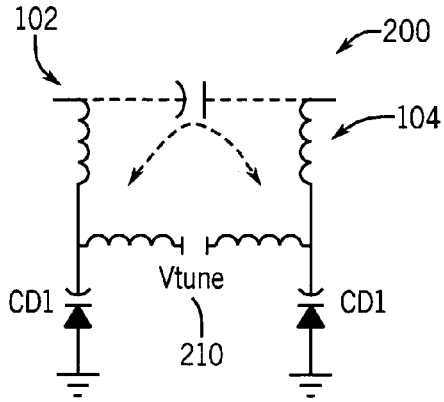
FIG. 2A is an actively tuned filter including first and second resonators and further including a varactor diode associated with each resonator, according to an exemplary embodiment.
Figure 2B:
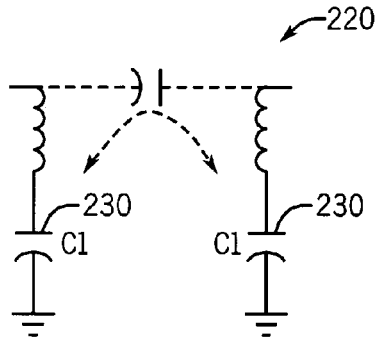
FIG. 2B is an actively tuned filter including first and second resonators and further including a drop in capacitor, according to an exemplary embodiment.

Referring to FIGS. 2A-B, actively tuned filter 100 is shown using different variable capacitance, according to alternative embodiments. Referring first to FIG. 2A, an actively tuned filter 200 is shown including first and second resonators 102 and 104 and further including a varactor diode 210 associated with each resonator. A variable capacitor is configured to provide variable capacitance dependent on the voltage applied across the diode to provide a continuous range of capacitance. This implementation allows continuous tuning across a frequency band. Advantageously, constant bandwidth can be produced at any frequency within the frequency range of the varactor. Referring now to FIG. 2B, an actively tuned filter 220 is shown including first and second resonators 102 and 104 and further including a "drop-in" capacitor 230. Actively tuned filter 220 may configured such that any capacitor may be used as capacitor 230, allowing the user to a variety of a specific desired frequency band dependent on the capacitor used as capacitor 230.

Figure 3A:
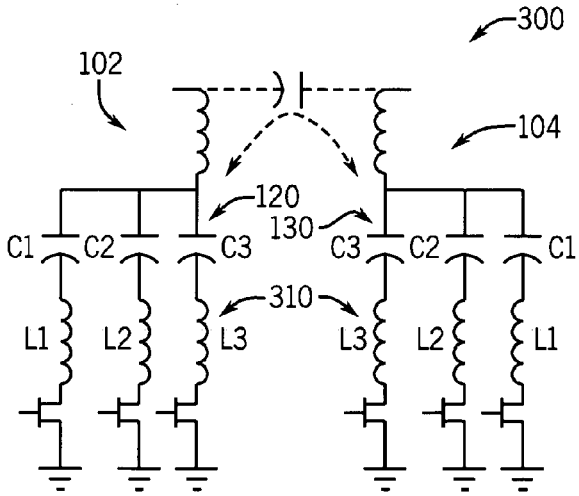
FIG. 3A is an actively tuned filter configured to enable continuous tuning with selectable bandwidth, according to an exemplary embodiment.
Figure 3B:
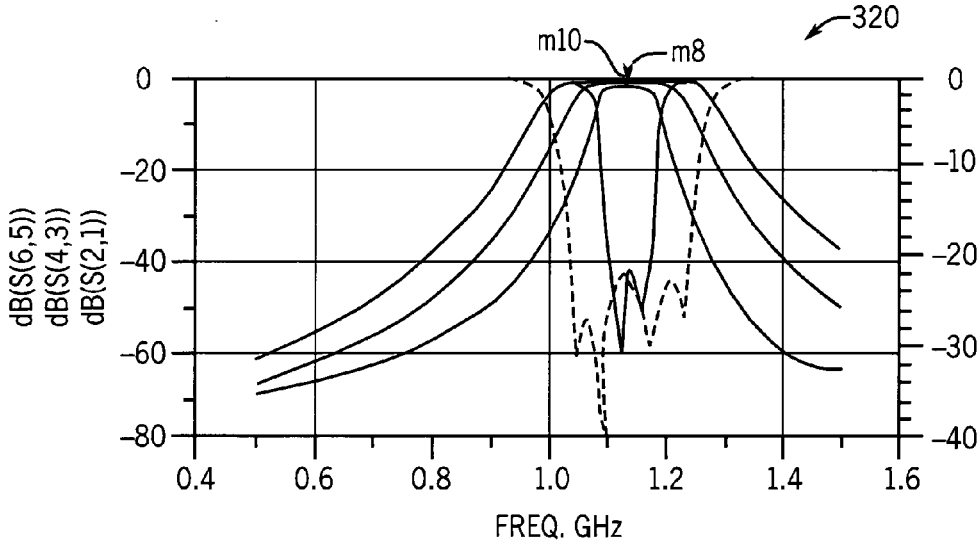
FIG. 3B is a graph of decibels vs. frequency showing various bandwidths at single frequency that occurs when utilizing inductors with the variable capacitance, according to an exemplary embodiment.

Referring now to FIG. 3A, an actively tuned filter 300 configured to enable continuous tuning with selectable bandwidth is shown, according to exemplary embodiment. Actively tuned filter 300 includes resonators 102 and 103 and variable capacitance 120 and 130 further include inductors 310 associated in series with each capacitor in variable capacitance 120 and 130 to allow variance of bandwidth at a fixed frequency. Actively tuned filter 300 features capacitors and inductors in series to vary the filter bandwidth while maintaining a constant center frequency. According to an alternative embodiment, the variable capacitance 102 and 103 may be replaced with a varactor, to provide a variable pass band with variable bandwidth. For example, a first inductor, L1, may be selected with the varactor to have a wideband filter with a range of, for example, 1-2 GHz. Referring to FIG. 3B, a graph 320 of decibels vs. frequency showing various bandwidths at single frequency that occurs when utilizing inductors 310 with the variable capacitance 102 and 103 is shown, according to an exemplary embodiment. As seen in the graph 320, connecting the inductors to the variable capacitance of a resonator allows for variable bandwidth at a constant frequency.

Figure 4:
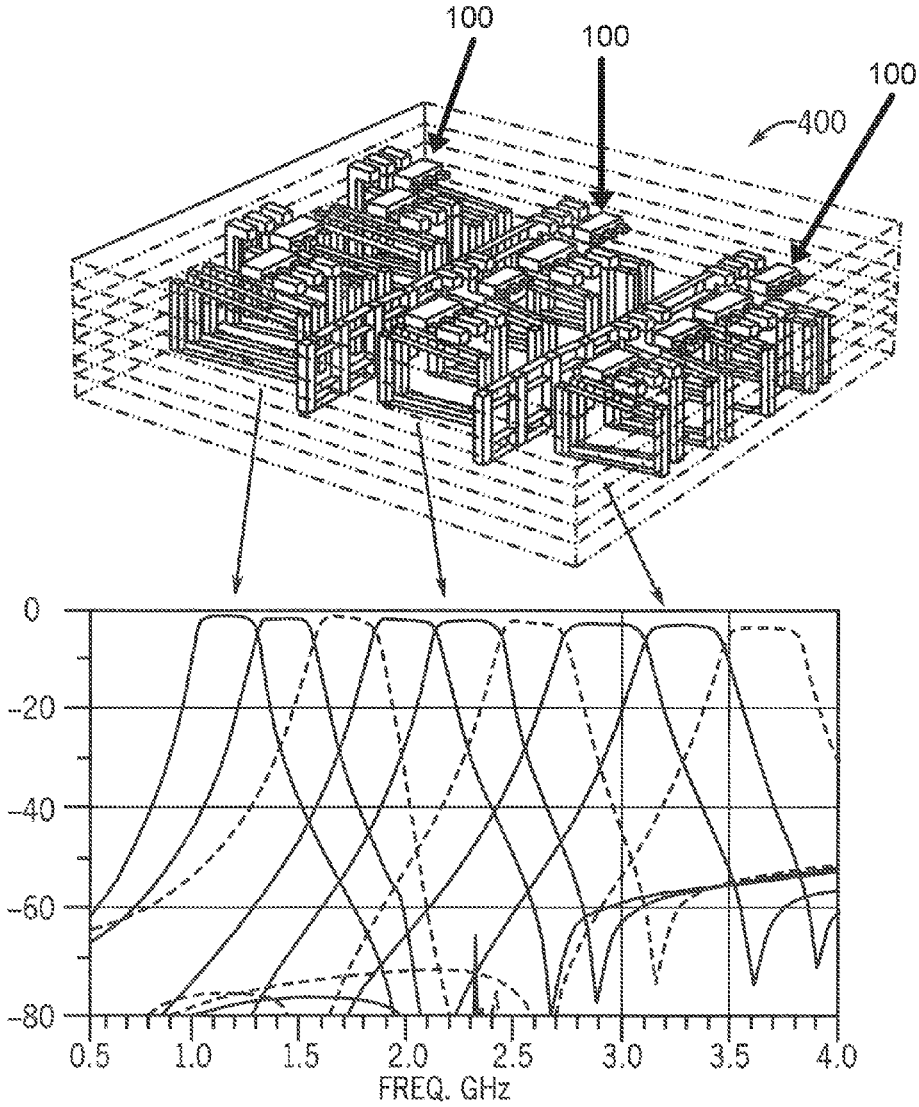
FIG. 4 is an actively tuned filter bank including a plurality of actively tuned filters, according to an exemplary embodiment

Referring now to FIG. 4, an actively tuned filter bank including a plurality of actively tuned filters 100 is shown, according to an exemplary embodiment. Each filter 100 may be selected to have finite, but complimentary tuning range. According to current limitations, which may change over time, the current frequency range may be approximately an octave. FIG. 4 illustrates an actively tuned filter bank having three actively tuned filters. The filters may be switched in with an RF switch. One of ordinary skill in the art would easily understand that the number and/or range of these filters can be varied.

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of resonator, number of capacitors, or inductors used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. An actively tuned filter, comprising:

first and second electromagnetically coupled coiled resonators, each of the first and second coiled resonators having an open end configured to receive an input and a shorted end configured to connect the corresponding first or second coiled resonator to a ground; and a plurality of variable capacitances, each of the variable capacitances including one or more capacitors allowing selection of a capacitance to be applied to the first and second coiled resonators, each variable capacitance being connected to the shorted end of the first or second coiled resonators, wherein each of the one or more capacitors of each of the variable capacitances is series coupled to an inductor, wherein each inductor is coupled to ground, wherein the first coiled resonator and the second coiled resonator are arranged in an end-to-end configuration, wherein an axis of the first coiled resonator and an axis of the second coiled resonator are aligned along a single longitudinal axis, wherein one or more coils of the first and second coiled resonators are circumferential to the single longitudinal axis.

2. The actively tuned filter of claim 1, wherein the one or more capacitors in each of the plurality of variable capacitances includes a voltage dependent variable capacitor.

3. The actively tuned filter of claim 1, wherein the one or more capacitors in each of the plurality of variable capacitances includes a plurality of capacitors.

4. The actively tuned filter of claim 3, wherein the plurality of capacitors are selectable using a switch.

5. The actively tuned filter of claim 1, wherein the one or more capacitors of some of the plurality of variable capacitances includes one or more varactors configured to provide a configurable bandwidth at a selectable frequency as defined by the ranges associated with each of the varactors and each of the inductors series coupled to one of the varactors.

6. A filter bank including a plurality of actively tuned filters, comprising:

at least two actively tuned filters, the at least two actively tuned filters configured to provide complementary tuning ranges, each of the at least two actively tuned filters including:

first and second electromagnetically coupled coiled resonators, each of the first and second coiled resonators having an open end configured to receive an input and a shorted end configured to connect the corresponding first or second coiled resonator to a ground, and a plurality of variable capacitances, each of the variable capacitances including one or more capacitors allowing selection of a capacitance to be applied to the first and second coiled resonators, each variable capacitance being connected to the shorted end of the first or second coiled resonators, wherein each of the one or more capacitors of each of the variable capacitances is series coupled to a corresponding inductor, wherein each inductor is coupled to ground, wherein the first coiled resonator and the second coiled resonator are arranged in an end-to-end configuration, wherein an axis of the first coiled resonator and an axis of the second coiled resonator are aligned along a single longitudinal axis, wherein one or more coils of the first and second coiled resonators are circumferential to the single longitudinal axis.

7. The filter bank of claim 6, wherein each of the one or more capacitors in each of the plurality of variable capacitances in at least one of the at least two actively tuned filters includes a voltage dependent variable capacitor.

8. The filter bank of claim 6, wherein each of the one or more capacitors in each of the plurality of variable capacitances in at least one of the at least two actively tuned filters includes a plurality of capacitors.

9. The filter bank of claim 8, wherein the plurality of capacitors of at least one actively tuned filter are selectable using a switch.

10. The filter bank of claim 6, wherein the one or more capacitors of some of the plurality of variable capacitances includes one or more varactors configured to provide a configurable bandwidth at a selectable frequency as defined by the ranges associated with each of the varactors and each of the inductors series coupled to one of the varactors.

11. An actively tuned filter, comprising:

a first resonator having an open end configured to receive an input and a shorted end configured to connect the first resonator to ground;

a first variable capacitance including one or more capacitors allowing selection of a capacitance to be applied to the first resonator, the first variable capacitance being connected to the shorted end of the first resonator between the first resonator and the ground, wherein each of the one or more capacitors of the first variable capacitance is series coupled to an inductor, wherein each inductor is coupled to the ground;

a second resonator having an open end configured to provide an output and a shorted end configured to connect the second resonator to ground; and a second variable capacitance including one or more capacitors allowing selection of a capacitance to be applied to the second resonator, the second variable capacitance being connected to the shorted end of the second resonator between the second resonator and the ground, wherein each of the one or more capacitors of the second variable capacitance is series coupled to an inductor, wherein each inductor is coupled to the ground, wherein the first resonator and the second resonator are electromagnetically coupled coiled resonators configured to perform a filtering function, wherein the first resonator and the second resonator are arranged in an end-to-end configuration, wherein an axis of the first resonator and an axis of the second resonator are aligned along a single longitudinal axis, wherein one or more coils of the first and second coiled resonators are circumferential to the single longitudinal axis.

12. The actively tuned filter of claim 11, wherein the one or more capacitors in at least one of the first and second variable capacitances includes a voltage dependent variable capacitor.

13. The actively tuned filter of claim 11, wherein the one or more capacitors in at least one of the first and second variable capacitances includes a plurality of capacitors.

14. The actively tuned filter of claim 13, wherein the plurality of capacitors are selectable using a switch.

15. The actively tuned filter of claim 11, wherein at least one of the one or more capacitors in each of the first and second variable capacitances is a varactor configured to provide a configurable bandwidth at a selectable frequency as defined by the ranges associated with each of the varactors and each of the inductors series coupled to one of the varactors.

* * * * *